US005551804A

United States Patent [19]

Breaux et al.

[11] Patent Number: 5,551,804

[45] Date of Patent: Sep. 3, 1996

[54] METHOD OF DRIVING A PILE

[75] Inventors: Larry D. Breaux; James A. Haney, both of Houston, Tex.; Daniel M. Houser, Thibodaux, La.

[73] Assignee: McDermott International, Inc., New Orleans, La.

[21] Appl. No.: 427,372

[22] Filed: Apr. 24, 1995

[51] Int. Cl.[6] ..... E02D 5/28; E02D 7/10

[52] U.S. Cl. ..... 405/227; 405/232

[58] Field of Search ..... 405/227, 242, 405/232, 288

[56] References Cited

U.S. PATENT DOCUMENTS

| | | | |
|---|---|---|---|
| 2,736,172 | 2/1956 | McChosney | 405/227 |
| 4,351,624 | 9/1982 | Barber | 405/227 X |
| 4,373,835 | 2/1983 | Haney | 405/227 X |
| 4,637,757 | 1/1987 | Aagaard | 405/227 |
| 4,721,416 | 1/1988 | Gracia | 405/227 |
| 4,812,080 | 3/1989 | Urquhart et al. | 405/227 |

FOREIGN PATENT DOCUMENTS

| | | | |
|---|---|---|---|
| 3338136 | 5/1985 | Germany | 405/227 |

*Primary Examiner*—David J. Bagnell
*Attorney, Agent, or Firm*—Robert J. Edwards; D. Neil LaHaye

[57] ABSTRACT

A pile is plugged at its lower end or tip region so as to make it easier to drive. Additionally, such a plugged pile facilitates the transportation and handling of the pile prior to its driving.

9 Claims, 2 Drawing Sheets

METHOD OF DRIVING A PILE

FIELD AND BACKGROUND OF THE INVENTION

The present invention relates, in general, to offshore technology and, in particular, to a new and useful method that makes cylindrical piling easier to drive. The method works particularly well for piling driven in sensitive clays. In addition to making the piling easier to drive, the installation operations required to install piling for an offshore platform are greatly facilitated. The method involves putting a plug in the pile at or near its bottom end and leaving this plug in place during the driving of the pile.

The use of piling in offshore platforms has evolved over many years and includes a wide variety of known operations. Generally, however, the pile is driven either through the legs of a jacket or template already in place on the sea floor or through sleeves attached to the jacket.

In any event, a derrick barge carrying lengths of pile as well as pile add-ons is generally secured adjacent the site where the driving operation is to occur. These pile add-ons extend the length of the pile until it reaches the seabed. This pile is then driven into the seabed with additional add-ons being supplied as needed until the desired depth is reached.

Occasionally, removable closure plates are installed in the pile to add buoyancy to selected sections of the pile. This buoyancy reduces the hook load on the derrick that must be provided to manipulate the pile and its add-ons as it is lowered to the seabed.

U.S. Pat. Nos. 4,696,603, 4,696,604, and 4,705,430 disclose various compliant tower or composite leg platform designs. These structures require piling that is much longer and heavier than that which has been installed to date. A single pile for a compliant tower may weigh 2,000 tons and have a length of over 2,000 feet. In contrast, a current single skirt pile might weigh only about 400 tons and have a length of about 550 feet. Thus, currently known problems regarding the manipulation and lowering of existing piles with add-ons are greatly exacerbated by the 4 or 5 fold increase in pile weight and length associated with such compliant towers.

U.S. Pat. No. 5,060,731 discloses a well conductor, as contrasted with a pile, that is plugged and then driven to a design penetration depth afterwhich the plug is drilled out as the drilling rig begins drilling the well. However, as can be appreciated, conductors are normally 22 to 30 inches in diameter whereas piling for offshore platform foundations is often in the 72 to 96 inch diameter range. Also, such well conductors are often only driven to a rather shallow range of about 200–300 feet as compared to the driven depth for anchoring purposes which involves considerably deeper penetrations.

It is, therefore, an object of this invention to make piling easier to drive regardless of its length, desired penetration depth, or diameter. A further object of this invention is to reduce or eliminate the large support structures on the platform that are normally required or associated with the driving of piles. Yet another object of this invention is to facilitate and expedite pile driving operations thereby reducing their costs. It is also an object of this invention to achieve all of the operational advantages of a sealed pile, such as its control and buoyancy advantages, without the disadvantage of having to remove any of the seals. Another object of this invention is to make piles easier to drive in sensitive clays. Driving may also be easier in other types of soils, but the effect will be less pronounced than in sensitive clays. Still another object of this invention is to make the pile easier to transport, handle at the site, assemble, and lower.

For a better understanding of the invention, its operating advantages and specific objects attained by its uses, reference is made to the accompanying drawings and descriptive matter in which the preferred embodiments of the invention are illustrated.

SUMMARY OF THE INVENTION

The invention comprises the use of a plug at or near the bottom or end of a pile during handling, assembly, and lowering of the pile to self support in the sea bottom, followed by the driving of the pile with the plug intact. General consensus in the industry is that the plug will make the driving of the pile more difficult since it presents more of a profile that must be moved through the soil. However, this was not found to be the case in highly sensitive clays, the driving of a plugged pile is considerably easier than the driving of an open pile. While plugs have been employed in the past to facilitate certain aspects of pile transportation, handling, assembly, and lowering, they were always removed prior to pile driving because of the belief that the plug would make the pile more difficult or impossible to drive. Previously, the advantages derived from using plugs did not compensate for the costs related to installing and removing the plugs.

DESCRIPTION OF PREFERRED EMBODIMENTS

Figure 1:
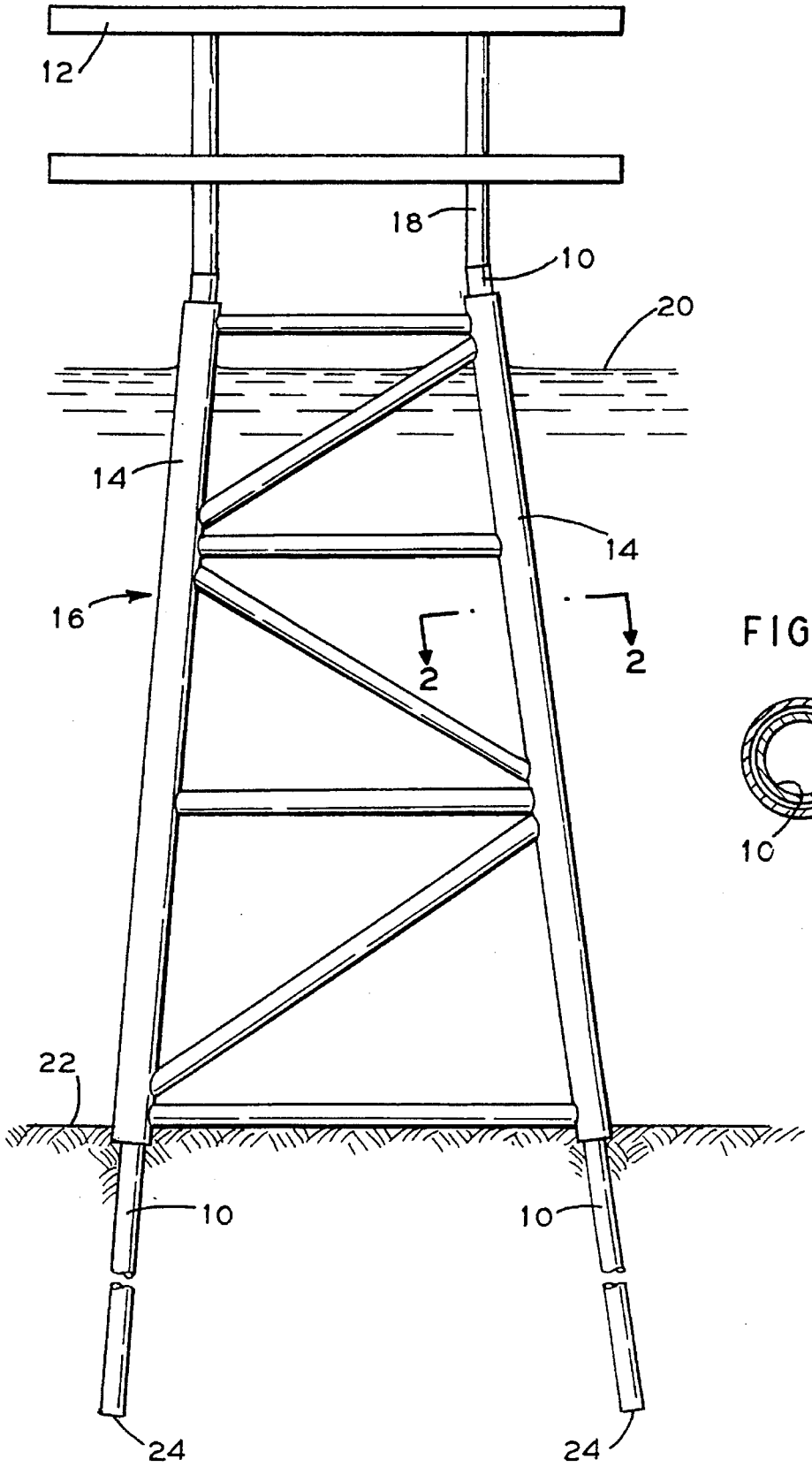
FIG. 1 is a side elevational view of a pile driving template or jacket.
Figure 2:
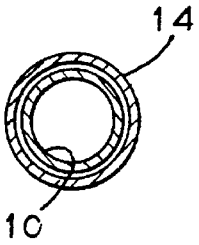
FIG. 2 is a sectional view taken along lines 2—2 of FIG. 1.

Referring to FIGS. 1 and 2, piling 10 for offshore platform 12 is generally driven through the hollow tubular legs 14 of a pile driving template or jacket 16. Piling 10 and jacket legs 14 are generally both made from pipe with piling 10, of course, being sized slightly smaller than the inside diameter of leg 14.

After pile 10 has been driven to the design penetration depth, deck leg 18 is secured thereto above sea level 20 for the support of platform 12. Piling 10 installed in this manner is commonly referred to as main piling. Such piling 10 ranges from two to ten feet or more in diameter and can weigh from a few tons to several hundred tons. The total length of such piling 10 varies from about 200 to over 1,200 feet or more.

In the past, such piling has been open ended so as to displace as little soil below mudline 22 as possible. In other words, open-ended piles slice through mudline 22 as if a core of mudline 22 is being taken. Consequently, the driving force of the pile must not only overcome the soil resistance or soil shear along its outer perimeter, but this force must also overcome the resistance or shear of the soil now contained within the pile In accordance with this invention, however, pile 10 is plugged at its end region 24. This plug may take the shape of a cone or it can be rounded or flush with end 24 of pile 10. It can also be of any other shape, the important feature being that pile 10 is now plugged rather than being open.

Driving a plugged pile 10 is contrary to current knowledge which holds that driving such a blunt object (remember that pile 10 is from 2 to 10 or so feet in diameter) is more difficult than driving an open pile which slices through mudline 22. This common belief is held because as plugged pile 10 advances, it presents a greater area subject to soil end bearing than would otherwise be seen by an open pile. Additionally, since the pile is plugged, the displaced soil must be moved to the outside of the pile whereas in an open pile, thee soil merely moves up within the pile without being forced or moved to the outside.

However, is was found that highly sensitive clays, such as those found below mudline 22 in the Gulf of Mexico, become remolded once they are disturbed. These clays were also found to temporarily lose much of their strength when they are so remolded thereby invalidating the presumption that a greater driving force is needed to drive a plugged pile. In fact, it was discovered that the actual driving force required to drive such a blunt pile 10 in such soils was actually reduced threefold or more!

Another factor in a lower driving force required to drive plugged pile 10 is the fact that in open piles, the soil plug inside the pile absorbs much of the driving energy of the hammer in internal damping. In contrast, plugged pile 10 has only water (or air) inside which obviously absorbs much less energy than the soil plug. This enables more of the driving force to be applied to advancing the pile.

Figure 3:
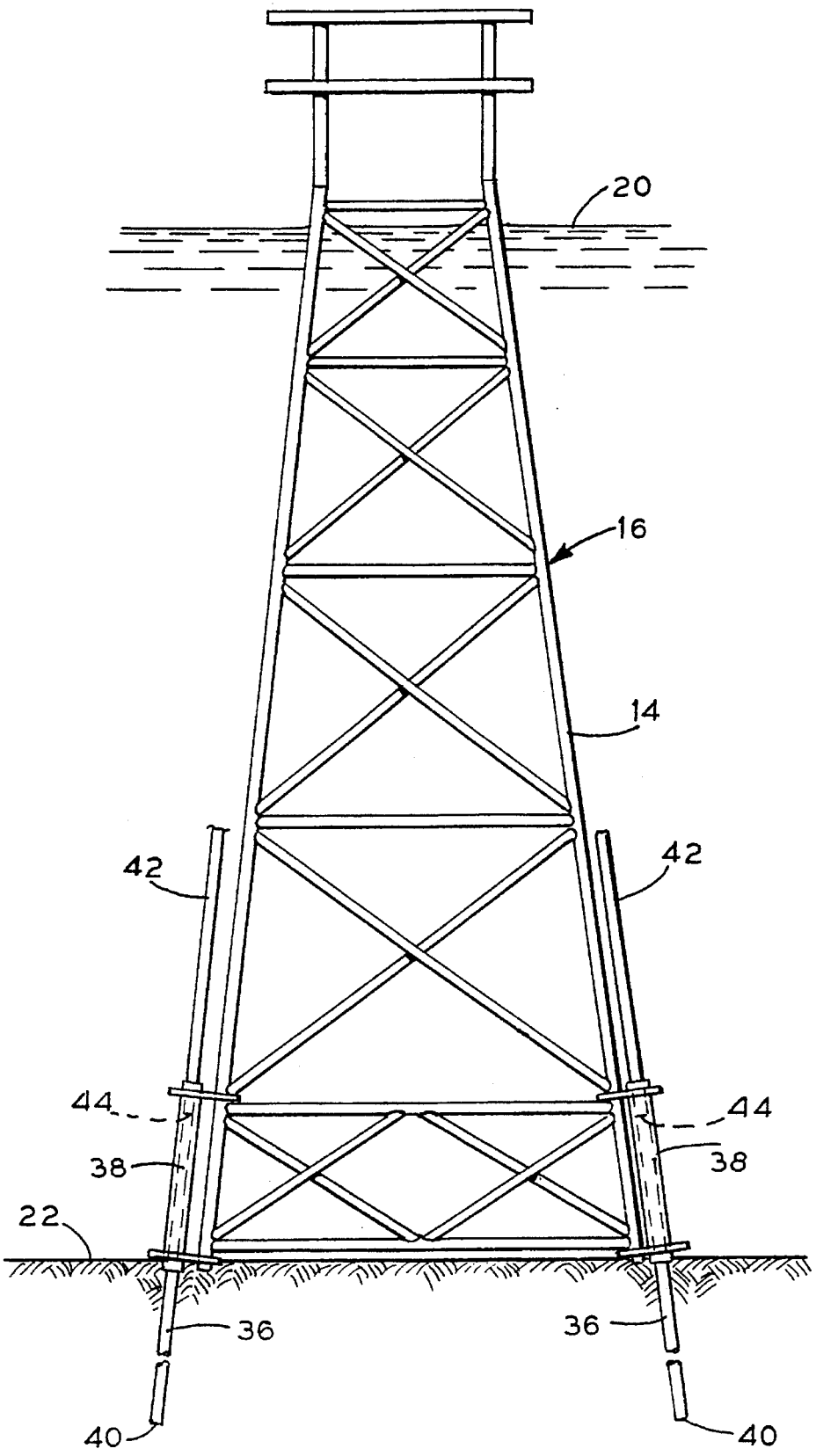
FIG. 3 is a side elevational view of a platform supported on skirt piles.

The present invention can be used in operations involving pile handling and driving that have been employed over the years. One Advancement in pile driving was the introduction of battered skirt piling 36 as shown in FIG. 3. The present invention of plugging the ends of skirt piling 36 is also applicable in such cases. Normally, skirt piling 36 is driven through sleeves 38 secured to a lower region of legs 14. However, such skirt piles 36 do not extend the entire length of legs 14, instead they extend upward from mudline 22 a distance of generally only one bay of jacket 16. Also, like legs 14 of jacket 16, sleeves 38 oftentimes extend at an angle with respect to mudline 22. To install such skirt piling 36, however, a follower pile 42 is secured to the top of the skirt piling 36 that has had its end 40 plugged and driven to the desired depth in the normal fashion. Oftentimes, holding devices such as internal or external grippers are utilized to lift and lower skirt pile 36 rather than support lugs. In other cases, an underwater hammer can be utilized to drive skirt pile 36 without the need for a follower pile (or at least a reduced length follower pile).

Some examples of the improvements provided by this invention for both main piled and skirt piled jackets are as follows:

First, when main piles are assembled, they must be hung from the top of jacket leg 14 using support lugs or grippers or the like. The weight of main pile string 10 is then delivered through the jacket 16 to the mudmats at the mudline 22. If pile 10 is plugged, then its buoyancy greatly reduces the load that these items must carry, thereby making them lighter and more economical to construct and install.

Second, when main pile 10 is lowered, it must be lifted by a derrick. If pile 10 is plugged, then the derrick, the gripper, and the rigging required to make the lift can be of lower capacity. This will often mean that a lower capacity block, which will be smaller and faster, can be used for handling pile 10.

Third, often battered skirt piles 36 are assembled from sections working from the top of jacket 16. This skirt pile string 36 is then lowered to self support and driven utilizing a follower string or pile 42. Plugged piling offers the same advantages in this instance as it does for main piles. Also, if a removable closure plate 44 is installed near the top of plugged skirt pile 36, then the weight of the follower string or pile 42 will be utilized to push skirt pile 36 down against the resultant upward buoyant force. Thus, a simple gravity connection (compression only) between skirt pile 36 and the follower string 42 will function for both the lowering and driving operations of pile 36. After driving, the follower string 42 is simply lifted off skirt pile 36. In contrast, in an unplugged skirt pile, i.e. one not buoyant, the skirt pile must hang from the follower string during the lowering operation so that after the pile is driven, the tension connection between the skirt pile and the follower must also be released before the follower can be retrieved.

Fourth, should a one piece skirt pile, battered or vertical, be plugged and a closure plate installed near the top of the pile, then the pile will float and a number of operations will be facilitated. For instance, a wet tow of the pile is possible, or the piling may be loaded out on a transport barge and side launched at the site. The pile may be upended at the site using a combination of flooding and lifting with the derrick barge, or it might be upended without derrick assist by selectively flooding one or more bottom chambers formed by installing additional closure plates within the pile. Once upended the pile can be lowered using much lighter rigging than would be possible with an open ended pile. A smaller, faster block on the derrick or possibly even a winch can be used to lower the pile to self support in the sea floor, possibly without having to stop and change rigging because of limits on block travel.

Fifth, when a plugged pile iS driven with an underwater, slim-line hammer in the free riding mode, the problem of venting the water from the interior of the pile is eliminated. This permits a smaller annulus between the hammer and the pile and a smaller driving shoulder for the hammer anvil to strike.

Sixth, when support lugs for either an external or internal gripper are used to handle or hang a pile or follower string, these devices induce stresses in! the region of the pile or follower upon which they act. The stresses induced are proportional to the weight of the pile or follower string and can control the design of that region of the pile or follower string. The reduction of the effective weight of a plugged, buoyant pile eliminates this problem.

Seventh, all of the advantages already stated for a plugged pile are much more pronounced for the extended piles of a compliant tower because of their much greater weights and lengths. Furthermore, the plug and any closure plates installed do not have to be removed as they do in driving techniques utilizing conventional piles. Thus, any problems associated with the removal of the plug or these closure plates are eliminated.

While a specific embodiment or, the invention has been shown and described in detail to illustrate the application of the principles of the invention, it will be understood that the invention may be embodied otherwise without departing from such principles.

What is claimed is:

1. A method of driving a hollow tubular pile string into the seabed comprising the steps of:

(a) closing or plugging a lower end of a pile;

(b) temporarily suspending said pile from a support located above the waterline;

(c) reducing the load upon said support by controlling the buoyancy of said pile;

(d) adding additional lengths to said pile, thereby forming a pile string, while said pile string is temporarily suspended from said support;

(e) incrementally lowering said pile string toward the seabed until self-support is reached; and, (f) driving said closed or plugged lower end of said pile into the seabed until a desired penetration depth is reached, said step of driving causing the seabed to be displaced around said closed or plugged lower end.

2. The method as set forth in claim 1 wherein said step of lowering said pile string comprising the step of temporarily lifting said pile string from said support and thereafter lowering said pile string a distance generally equivalent to the length of said added additional length before said pile string is again temporarily suspended by said support.

3. The method as set forth in claim 2 further comprising the step of constructing and arranging said support as an open top leg of a jacket supported upon the seabed.

4. The method as set forth in claim 3 further comprising the step constructing and arranging said pile string as a main pile passing through said open top leg of said jacket.

5. The method as set forth in claim 2 further comprising the step of angling said pile string with respect to the seabed.

6. The method as set forth in claim 1 further comprising the step of installing a second closure plate or plug in said pile string above said lower end thereby fully enclosing the length of said pile string therebetween.

7. The method as set forth in claim 6 further comprising the step of attaching a follower pile to said pile string above said second closure plate or plug.

8. The method as set forth in claim 7 further comprising the step of attaching said follower pile to said pile string via a compression fitting.

9. The method as set forth in claim 8 further comprising the step of constructing and arranging said pile string as a battered skirt pile.

* * * * *